US008790509B2

(12) United States Patent
Vu

(10) Patent No.: US 8,790,509 B2
(45) Date of Patent: Jul. 29, 2014

(54) PROCESS FOR THE TREATMENT OF CRUDE OIL, PROCESS FOR THE SEPARATION OF A WATER-IN-OIL HYDROCARBON EMULSION AND APPARATUS FOR IMPLEMENTING THE SAME

(75) Inventor: Van-Khoi Vu, Paris (FR)

(73) Assignee: Total S.A., Courevoie (FR)

( * ) Notice: Subject to any disclaimer, the term of this patent is extended or adjusted under 35 U.S.C. 154(b) by 1538 days.

(21) Appl. No.: 10/563,329

(22) PCT Filed: Apr. 15, 2005

(86) PCT No.: PCT/EP2005/004654

§ 371 (c)(1),
(2), (4) Date: Mar. 27, 2007

(87) PCT Pub. No.: WO2005/100512

PCT Pub. Date: Oct. 27, 2005

(65) Prior Publication Data

US 2007/0267325 A1 Nov. 22, 2007

(30) Foreign Application Priority Data

Apr. 15, 2004 (EP) ..... 04291012

(51) Int. Cl.
*C10G 33/00* (2006.01)
*C10G 33/06* (2006.01)

(52) U.S. Cl.
USPC ..... 208/187; 196/46

(58) Field of Classification Search
USPC ..... 585/3, 10; 252/49.6; 208/187, 348, 370; 203/20; 201/9; 196/14.52, 46
See application file for complete search history.

(56) References Cited

U.S. PATENT DOCUMENTS 2,730,190 A * 1/1956 Brown et al. ..... 95/253

FOREIGN PATENT DOCUMENTS

| | | |
|---|---|---|
| CA | 915 589 A | 11/1972 |
| DE | 12 23 805 B | 9/1966 |
| WO | WO 92/19351 | 11/1992 |

OTHER PUBLICATIONS

International Search Report dated Jul. 25, 2005.

* cited by examiner

*Primary Examiner* — Renee E Robinson
(74) *Attorney, Agent, or Firm* — Polsinelli PC

(57) ABSTRACT

The invention relates to a process for the purification of crude and apparatus for its implementation. This process comprises a separation into gas and degassed emulsion and separation of the degassed emulsion into water and oil. The invention also relates to a process of separating a hydrocarbon emulsion and apparatus for implementing this. This process comprises washing of the emulsion at an oil/water interface.

31 Claims, 4 Drawing Sheets

PROCESS FOR THE TREATMENT OF CRUDE OIL, PROCESS FOR THE SEPARATION OF A WATER-IN-OIL HYDROCARBON EMULSION AND APPARATUS FOR IMPLEMENTING THE SAME

FIELD OF THE INVENTION

The invention relates to a process for the treatment (purification) of crude oil (produced from a well, i.e. production crude oil) and apparatus for implementing it, and a process for separating a water-in-oil hydrocarbon emulsion and apparatus for implementing this.

STATE OF THE ART

Crudes or crude oils (produced from wells or issued from reservoirs, or known as production crudes) must be processed in order to comply with three main characteristics:

- RVP vapor pressure (Reid Vapor Pressure), typically less than 11 psi, to ensure that the crude is stable and to avoid any degassing during transport or storage,
- volume % of water and sediment or BSW (Basic Sediment and Water), generally 0.5% v/v at the most,
- Salinity, generally less than 100 mg/l (equivalent NaCl), in particular less than 60 mg/l.

Processing is therefore carried out in a conventional way. The problem is however a special one in the case of offshore fields, more specifically in deep water, where the processing units are often on floating supports. These are generally FPSOs (Floating Production Storage and Off-loading)—vessels equipped with facilities for the processing, production and offloading of petroleum fluids—or a combination between an FPU (Floating Production Unit)—barges equipped with petroleum fluid processing and production facilities—and an FSO (Floating Storage and Off-loading)—vessels or barges equipped with storage tanks and facilities for unloading petroleum fluids. In all cases this processing is carried out in what is called the "topsides", that is the upper part of the floating support.

Processing of this type is only the application of systems which exist onshore to offshore on floating units. Because of this these systems suffer from several problems, in particular size, topsides weight, purchasing cost and operating cost.

The aim of the invention is to overcome one or more of these problems.

WO-A-9219351 describes a process for the separation of a drilling fluid of the "underbalanced drilling" type, that is a fluid typically containing (by weight): solids from the rock (drill cuttings): 5 to 15%; solids for the control of density and emulsifiers (bentonite, barytes, polymers, etc.): 5 to 35%; liquid phase of the sludge (water or initial synthetic hydrocarbons): 50 to 85%; liquid phase of the hydrocarbons from the field: 5 to 10%. This type of drilling fluid is not in any way comparable with a production crude, namely one mainly containing hydrocarbons from the field and water, with relatively few solids (typically less than 10%, generally less than 5%). This document describes means for the separation of this drilling fluid, comprising venting and recovering of some of the solids, and dispatch of the emulsified phase (still containing solids) to a separating unit in which each phase, namely oil, water and interface, are recovered and processed. An emulsion interface flow is specifically drawn off for delivery to a cyclone separator.

DE-A-1223805 describes a process and apparatus for distributing hot water above the oil phase during water/oil decantation.

CA-A-915589 describes a conventional three phase (oil/water/gas) separation process.

SUMMARY OF THE INVENTION

The invention therefore provides a process for the treatment or processing (purification) of production crude comprising the following stages: (a) separation of the crude into two phases (or fractions), i.e. gas and degassed emulsion, and (b) separation of the said degassed emulsion into water and oil, where the oil will notably fulfill the commercial requirements, said treatment process being able to perform the three functions of stabilization (obtaining the required RVP), dewatering (or dehydrating) (obtaining the required BSW) and desalting (obtaining the required salt content).

The invention also provides apparatus for treating (purifying) a production crude comprising: (a) a unit for separating the crude into two phases (or fractions), i.e. gas and degassed emulsion, and (b) a vessel separating the said degassed emulsion into water and oil.

The invention also provides a process for separating a water-in-oil hydrocarbon emulsion comprising the following stages: (i) washing said degassed emulsion with a water leg having a sufficient height in a vessel and (ii) recovery of a flow of oil and a flow of water. The water leg height is generally from 3 to 15 m, and preferably from 4 to 12 m. In one embodiment, the water content of the degassed emulsion is brought by water addition to a value from 15 to 35% (vol) prior to its introduction into the vessel. Hence, the invention also provides a process for the separation of a water-in-oil hydrocarbon emulsion comprising the following stages: (i) passing the degassed emulsion to the bottom of a washing vessel, and (ii) recovery of a flow of oil and a flow of water.

The invention also provides a process for separating a water-in-oil hydrocarbon emulsion comprising the following stages: (i) creation of an oil/water interface, (ii) washing the said emulsion with water at the oil/water interface, and (iii) recovery of a flow of oil and a flow of water.

The invention also provides an apparatus for separating a water-in-oil hydrocarbon emulsion comprising a vessel fitted with a spray or water distribution system for washing the said emulsion with water at the oil/water interface.

The invention also provides an apparatus for the separation of a water-in-oil hydrocarbon emulsion comprising a vessel fitted with a feed for said emulsion at the bottom of said vessel, and further comprising downstream of said vessel a settler.

The invention also provides a ship or barge comprising one of the apparatus according to the invention.

DETAILED DESCRIPTION OF EMBODIMENTS OF THE INVENTION

The invention will now be described more particularly with reference to the appended drawings.

Figure 1:
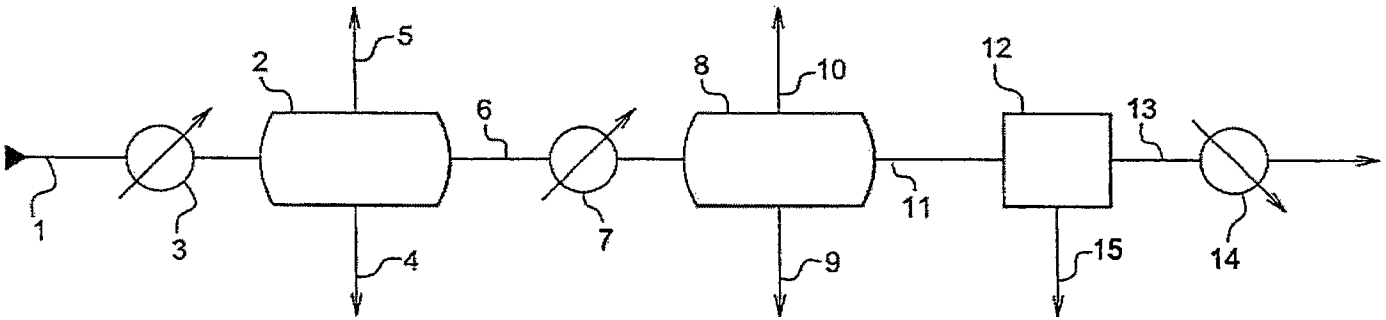
Fig. 1 Prior art
FIG. 1 is a flow chart of a process according to the prior art.

With reference to FIG. 1, a conventional scheme for a multi-stage separation process (in general 2 to 3 stages, 2 stages being illustrated in FIG. 1) will be described, the components being on the topsides of the ship. The crude (or heavy oil) containing an oil phase in total or partial emulsion with an aqueous phase and a gas phase arrives at first separator (2), also known as a "slug catcher", via a pipe (1). This first separator performs the function of two-phase (liquid/gas) or three-phase (oil/water/gas) separation and also performs the function of preventing slugs or excess pressures from passing to subsequent levels in the process. Insofar as the remainder of the process relates to the separation of an emulsion, any instability, surge or excess pressure in the process will have an adverse effect because it will disturb the gravity separation of water droplets in the oil phase and gravity ascension of oil droplets in the water phase and, as a consequence, gas/liquid and oil/water separations throughout the rest of the processing. This is why the residence time in the first separator is generally quite long—several minutes, often more than five minutes. In the case of large flows the first separator or slug catcher has a large volume, up to many times the volume of the riser or the well tubing or casing. Volumes may amount to several hundred $m^3$. Whereas such volumes should not give rise to any problems on shore, they may give rise to problems offshore.

In order to assist separation in general the fluids are heated in an exchanger (3) before the first or second separator. Typically the operating conditions in the first separator are: temperature 60-90° C. and pressure 10-20 bars; exceptionally the pressure may even exceed 50 bars.

In a conventional processing scheme, in order to comply with the RVP, BSW and salt specifications the following operations must be performed before crudes are transferred to the storage tanks:

control of slugs of gas and liquid (slug-catcher),
water/oil separation,
stabilization of the crudes, and
dewatering and desalting.

Typically heating of the fluids to a temperature from 45° C. to 65° C. is required partly to improve oil/water separation, i.e. the coalescence of droplets and their settling out in the liquid phases, and partly to encourage degassing of the crudes in order to stabilize them. In order to achieve these functions of dewatering and desalting, the operating temperature is most often between 80° C. and 100° C.

The separators operate most often as three-phase separators. The separated water is passed to the water treatment unit (not shown) via a pipe (4). The gas leaves the separator via a pipe (5) to a gas processing unit (not shown). The separated oil phase leaves the separator through a pipe (6) towards a further separating unit.

The oil phase in pipe (6) is heated in an exchanger (7) before entering a second separator (8). The two heating stages are designed to ensure stabilization of the crude. The second separator is a three-phase separator and produces a flow of water, a flow of gas and a flow of oil phase. The operating conditions in the second separator are in general: temperature from 60° C. to 90° C. and pressure of the order of about 0.5 to 1 bar above the atmospheric pressure.

In a 3-stage separation system the second separator operates under pressure conditions which are intermediate between the pressure of the first separator and the pressure of the "atmospheric" separator. The oil phase is then passed to the third separator which operates at a pressure of the order of about 0.5 to 1 bar above the atmospheric pressure. The 3-stage variant will not be considered below; it is however to be understood that the problem of slugs or pressure and/or flow rates variations arises regardless of the number of stages.

Flows of water and gas are produced from pipes (9) and (10) respectively. The water is passed to the water treatment unit while the gas is passed to a gas treatment unit. A flow of oil phase is withdrawn from the separator through a pipe (11). Given that the last separator operates at a pressure close to atmospheric pressure, the liquids are also degassed. The oil phase flow still contains water (sometimes up to 10%). This flow is then passed to a desalting/dewatering unit. These two functions can be combined in a single device. In some cases where desalting is not necessary, dewatering alone may be carried out. This unit is indicated on the diagram (12) and is an electrostatic coalescer. A potential difference is applied between two plates to improve the oil/water separation. For the desalting function wash water is injected into the "fluids" stream at the inlet to the desalting unit, just upstream from a mixing valve. The wash water may be demineralised water, deaerated seawater, or previously treated production water.

The crude treated in this way is removed via a pipe (13) and then is cooled (e.g. up to about 45° C.) in an exchanger (14) before being passed either to storage tanks to await removal or directly to treated crude transport facilities such as oil tankers or pipelines. Water is drawn off from the dewatering or dehydrating unit (12) via a pipe (15) and passed to the water treatment unit or returned to one of the two separators mentioned above. In fact in some cases where the oil is difficult to separate from the aqueous phase, recycling of the water (aqueous phase) extracted from the equipment downstream helps oil/water separation by operating under conditions of so-called emulsion inversion, i.e. change from a water-in-oil emulsion to an oil-in-water emulsion, which is easier to separate.

Figure 4:
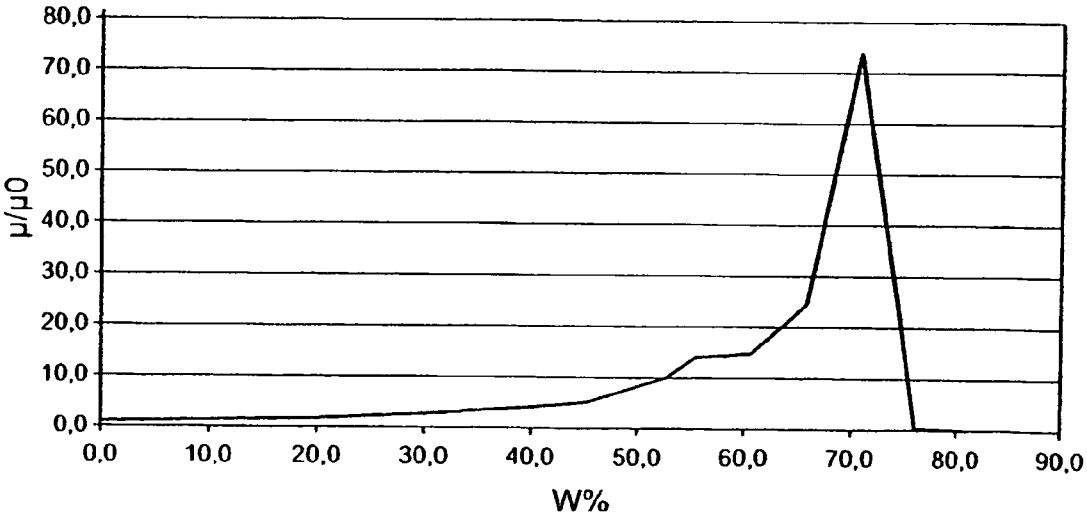
FIG. 4 is a graph showing the change in the viscosity of the emulsion of a petroleum fluid as a function of water content.

This is illustrated in FIG. 4, which provides an example of viscosity in relation to the water content of the emulsion. This may be a water-in-oil emulsion if the water content lies below a specific limit in the extracted fluid (e.g. 65%) or oil-in-water if the water content is over that limit. This limit corresponds to an inversion point for the emulsion and lies within a range from 0 to 80% water. The emulsion is easier to separate when it is an oil-in-water emulsion.

In addition to this the water which is returned to the separator is then discharged to the water treatment unit with the production water extracted in the separator. In particular the water return to the separator from the desalting unit becomes saturated with dissolved gases in the separator and therefore becomes easier to treat in the water treatment unit.

Water treated in the water treatment unit is either discharged to the sea or reinjected underground.

Figure 2:
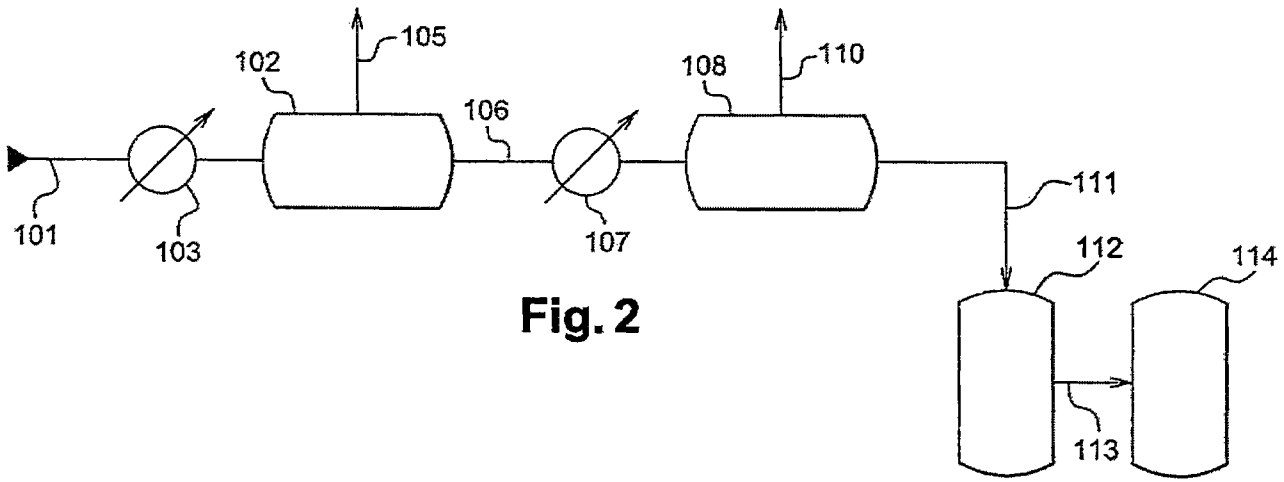
FIG. 2 is a flow chart of a process according to one embodiment of the invention.

An embodiment of a process according to the invention will be described with reference to FIG. 2. In this process the crude arrives via a pipe (100) at a first separator (102). In comparison with the first separator in the prior art this first separator may not perform the three-phase separation function nor the "slug catcher" function. It may only carry out the gas/liquid separation function. In fact in the process according to the invention it is possible to withstand excess liquid flowrates and pressures without interfering with downstream processing. In comparison with the first separator (2) in FIG. 1, the separator (102) is very much smaller, the volume generally being between 35% and 55% of that of separator (2) for the same throughput of crude being treated.

In the embodiment according to the invention only the degassing function is essential, for safety reasons. Heating to a maximum temperature of 65° C. (and generally from 40 to 45° C.) is generally sufficient to achieve the oil/water separation and oil stabilization in the vessels. This makes it possible to reduce retention times in the processing vessels, and also the vessel size. This temperature of 65° C. is an upper limit compatible with the protective paints on the treatment and storage vessels.

The separator (102) may be preceded by a heat exchanger (103), but this will receive less energy than its counterpart in the prior art. The separator (102) produces two flows, a gas flow via a pipe (105), and the other a liquid flow, namely an emulsion, via a pipe (106). The emulsion is passed to a separator at a pressure close to atmospheric pressure (108), possibly through an exchanger (107). Again the heat required is in general not as much as in the prior art. In some instances, the exchanger may be a cooler, to avoid any unnecessary recompressing.

The heat exchange surface areas according to the invention are very low and correspond generally to 10% to 30% of those required for the conventional process. The separator at atmospheric pressure is present mainly for the sake of safety, because the circulating fluids should be at atmospheric pressure. Nevertheless this second separator is not necessary for implementation of the invention if the first separator is at a pressure close to atmospheric pressure, because the second separator only performs a low pressure degassing function. As in the prior art the flow of gas is produced via a pipe (110) and this is treated in the same way. A degassed emulsified liquid fraction is obtained via a pipe (111). This emulsified liquid fraction contains oil and water in the form of an emulsion. Reference will again be made to FIG. 4 mentioned above.

In general it is not necessary to dewater this liquid fraction; this dewatering may however be carried out if necessary. The emulsified liquid fraction is then passed to the second part of the system according to the invention. This liquid fraction may be dewatered or on the contrary water may be added (particularly when transferring into the vessel). An emulsion whose water content has been adjusted to values of the order of 15 to 35% may for example be used.

Typically the operating conditions for the first separator are: temperature from 35° C. to 65° C. and pressure from 10 to 40 bars. Typically the operating conditions for the second "atmospheric" separator are: temperature from 45° C. to 65° C. and pressure from 1.2 bars to 2 bars absolute. This emulsified liquid fraction is then passed to the second part of the process.

The second part of the process is no longer located on the topsides, but in the hull of the floating support. A saving is thus obtained in the topsides, which in the prior art could amount to two or three deck levels. Savings can be of few hundreds of tons of equipment, i.e. thousands of tons taking into accounts ancillaries such as tubes, structures, etc. This second part includes at least one settling vessel in which the residence time for the fluids can typically vary between 4 and 24 hours.

The emulsified liquid fraction arrives via pipe (111) at washing and stripping vessel (112), which produces a flow of oil containing only little water (typically less than 0.5% BSW), this flow feeding a final settler (114) via a pipe (113) or an overflow. Water (typically demineralized water to obtain the desalting function) water and/or an acid (typically acetic acid) or desemulfying agents or any chemical agent may be added to the oil in pipe (113) if desired. The last settling vessel can be a storage vessel which does not need to be close to the washing (and stripping) vessel. In such a case, transfer of oil phase with little water towards storage vessel will take place owing to pumps installed in the washing vessel.

The degassed emulsified liquid fraction is a fraction which generally includes less than 5 $Nm^3$ of dissolved gas/$Nm^3$ of crude, in particular between 0.5 and 2 $Nm^3$ of dissolved gas/$Nm^3$ of crude. ($Nm^3$ indicating normal $Nm^3$).

Figure 3:
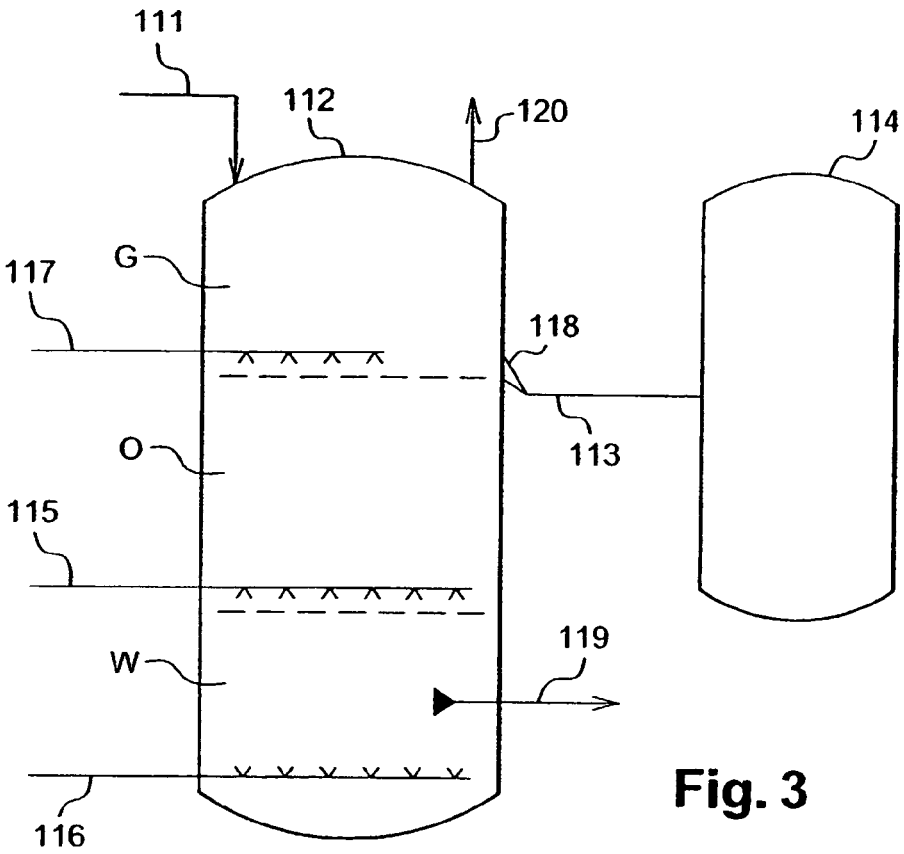
FIG. 3 is a view in cross-section of apparatus according to a second embodiment according to the invention.

An embodiment of the second part of the process according to the invention will be described with reference to FIG. 3. The degassed liquid fraction arrives via pipe (111) and enters the top of the vessel (112) or in a preferred variant the bottom of the vessel. In accordance with this embodiment the degassed emulsion enters the bottom of the vessel (112) and the oil then rises towards the interface and then towards the top where the oil phase is for example recovered via pipe (113). This embodiment is particularly suitable for acid or naphthenic crudes.

There are three phases, gas (G), oil (O) and water (W) in vessel (112). Just above the oil/water interface there is a water distribution system (115), for example a spray. The flow in the water distribution system is from 0% (at the start of production the crude does not contain water) to 90% by volume of the flow of fluids originating from the topsides, preferably 0% to 15% by volume. The spray is generally of the type producing drops of relatively large size, to encourage coalescence, especially at the emulsion zone in the water/oil interface. Washing said interface aims especially at diluting emulsifying agents (e.g. naphthenates) in the emulsion phase and thus at avoiding forming stable emulsions at the interface level.

Without wishing to be bound by theory, the applicant believes that the water distribution system has a number of effects. It contains or confines the emulsion towards the bottom. It acts on the consistency of what surrounds the droplet (especially by diluting emulsifying agents around the droplet), renders the emulsion less stable and encourages coalescence. It may alter the physical and chemical equilibria of the oil/water interface if chemicals such as acids or demulsifiers are injected in the wash water. The water distribution system also renders the interface "dynamic", in the sense that spraying prevents stagnation and creates continuous dilution in the interface region.

In one embodiment, washing by spraying water at the oil/water interface may be replaced (or used in addition with) by injecting a relatively high amount of water in the flow of degassed emulsion to be treated upon entry into the washing vessel. This allows renewing the washing water phase which comprises the water leg in vessel (112), and avoids that emulsifying agents concentrate and create stable emulsions. In a further embodiment, when the amount of water in the production crudes is in the range of 15 to 35% (vol), washing using a spray or water addition is no longer needed since the dilution effect of emulsifiers will be naturally obtained (in the water leg).

The stripping function is performed by injecting gas at the bottom of the vessel using a distributor (116). Typically gas injection is between 0 and 5 $m^2$ of gas per $m^3$ of liquid requiring treatment. Initially the gas increases the tendency to coalescence, because the bubbles of gas encourage agglomeration of the finer droplets. Secondly, when the gas is acid (in particular because of the presence of $CO_2$) this acidity will affect the naphthenates, preventing the formation of naphthenic salts. The acidity of the gas may impede the reaction which would otherwise take place in the presence of cations (such as $Ca^{2+}$). In addition to this the spray brings about dilution of the salt species formed, with would otherwise lead to deposits, these being again mechanically prevented by the fact of the lack of stagnation. Naphthenates are found in the separated water. Often, stripping is even not necessary because washing using a water leg in the vessel (112) and/or spraying at the interface oil/water are sufficient to achieve the required treatments.

Provision may also be made for additional washing through a water distribution system (117) similar to water distribution system (115) but this time at the gas/water interface.

In comparison with water distribution system (115) this water distribution system may only cover part of the cross-section of the vessel. It makes it possible to reduce or even eliminate foaming.

The water distribution and stripping systems thus make it possible to achieve one or more of the effects below:

- improvement of coalescence between water-in-oil or oil-in-water droplets (the type of emulsion depending upon the proximity to one phase or the other),
- achieve "local" phase inversion upon displacement of the emulsion phase from its introduction at the bottom of the vessel up to the interface, whereby an improved separation efficiency is obtained, in comparison with a conventional separator,
- breaking of the emulsions,
- elimination or reduction in the formation of organic and/or mineral deposits, in particular naphthenate soaps, asphaltenes or other organic or mineral deposits at the oil/water interfaces or in the oil and/or water phases.

The quality and composition of the wash water may vary and is defined in relation to the physical and chemical characteristics of the crudes being treated. The wash water (in the emulsion spray or at the entry of the vessel (112)) may be fresh water, untreated or treated (deoxygenated and/or filtered) seawater, or untreated or treated (filtration of solids and removal of suspended hydrocarbon residues, etc.) production water from the separators. The wash water may also contain various chemical additives such as acetic acid, demulsifiers, products to prevent organic or mineral deposits, etc. The quality and composition of the stripping gas may vary and are defined in relation to the physical and chemical characteristics of the crudes being treated. The stripping gas may be a gas obtained from topsides production, or flue gases (containing in particular $CO_2$) coming from the inerting gas units of the treated crude storage tanks, etc.

Operating conditions in vessel (112) are in general: the residence time in the vessel is from 4 to 24 hours, typically from 6 to 12 hours, the pressure lies for example between atmospheric pressure and a few hundred millibars (resulting from the injection of gas), temperature for example lies between ambient temperature and 65° C., generally between 40° C. and 50° C.

The size of the vessel depends upon the residence time and the flow; typically the size corresponds to that of a conventional storage vessel of a FPSO.

The fact that water is handled at this level, in the vessels, makes it easier and cheaper. In fact the quality of the water at the desalting units in the prior art is poor, whereas the water requiring treatment according to the invention is of better quality (due to the dilution effect and higher retention time).

The oil phase is for example recovered at an overflow (118) and then passed to the settler (114) via a pipe (113). The water generated is pumped from the bottom of the vessel and is passed to the water treatment unit via a pipe (119). The gas is removed via the header pipe (120) and is passed to the compressors.

The process used in the second part of the process may also be used for any type of emulsion and not necessarily for a degassed emulsion or not necessarily at the same location. The invention also covers this second part only, which involves washing and/or stripping and/or use of the water leg (especially with a degassed emulsion having a water content from 15 to 35 vol %).

The invention offers many advantages in comparison with the prior art. Firstly the fact that a major part of the process is located in the vessels makes it possible to economize on equipment on the topsides and it is also further possible to obtain a gain in ballast in the case of barges. In the state of the art, in order to keep the crude acid in order to prevent the deposition of naphthenates, it was often necessary to operate under pressure so that an acid gas was present at the same time as the crude. A high pressure always results in additional equipment, consumption and maintenance costs.

The process according to the prior art requires a greater input of heat (while at the end of the process it is necessary to cool the crude in order that it may be stored). In fact in the prior art the effects of residence time and heating are adjusted to break the emulsions, which means that considerable heating is required followed by cooling, operations which in practice double the size of the exchangers.

In the process according to the prior art the water required for separation in the case of fluids which are difficult to treat is a process water, whereas in the invention ordinary water may be used. Furthermore, when separating the emulsion in the prior art, if it was desired not to add too much water it was then necessary to adjust:

- the temperature (heat assisting the breaking of emulsions but as a downside promoting formation of organic deposits by influencing reaction kinetics), but this involves additional costs,
- the BSW, but the qualities of the final crude are then degraded, or drastic operating conditions are subsequently imposed on the dehydrating units,
- the retention time, but then large volumes are obtained,
- the added water must include chemical additives, which gives rise to a problem of cost and reprocessing.

The invention makes it possible to avoid one or more of these disadvantages.

Given that the process according to the invention can dispense with one or more dewatering or dehydrating units, there is net saving in equipment and operating costs.

The invention finds application for complex crudes or crudes which are often difficult to treat. Crudes obtained by drilling in deep water are difficult to treat because the gas which makes extraction possible is under high pressure and this gives rise to instabilities in the course of the operations. By way of example it is current practice to "manually" adjust the upstream valves on the topsides to handle the slugs which form. A complex crude is a crude having one or more of the following features:

- it is very viscous (e.g. several hundred cPs under normal temperature conditions),
- it is degraded (high acidity),
- it has a production water composition which is contaminated with reinjected water, this reinjected water being the water used in the topsides,
- it contains chemical compounds which encourage deposits such as ARN (product generating soaps, as named by company Statoil), naphthenates and carbonates (which can interact with the production water and promote formation of stable emulsions) or asphaltenes,
- it encourages foaming and/or emulsion when rising in the riser pipe,
- it contains paraffins, for example $C_{20+}$.

A typical complex crude according to the invention is a naphthenic crude.

The invention makes it possible to go from a residence time of 20-30 minutes in the topsides in the prior art to a residence time of less than 10 minutes, for example between 3 and 8 minutes, in particular of the order of 5 minutes or even 3 minutes, in the case of the invention.

Although the invention is particularly intended for use on a floating support, it may be used on shore.

Figure 5:
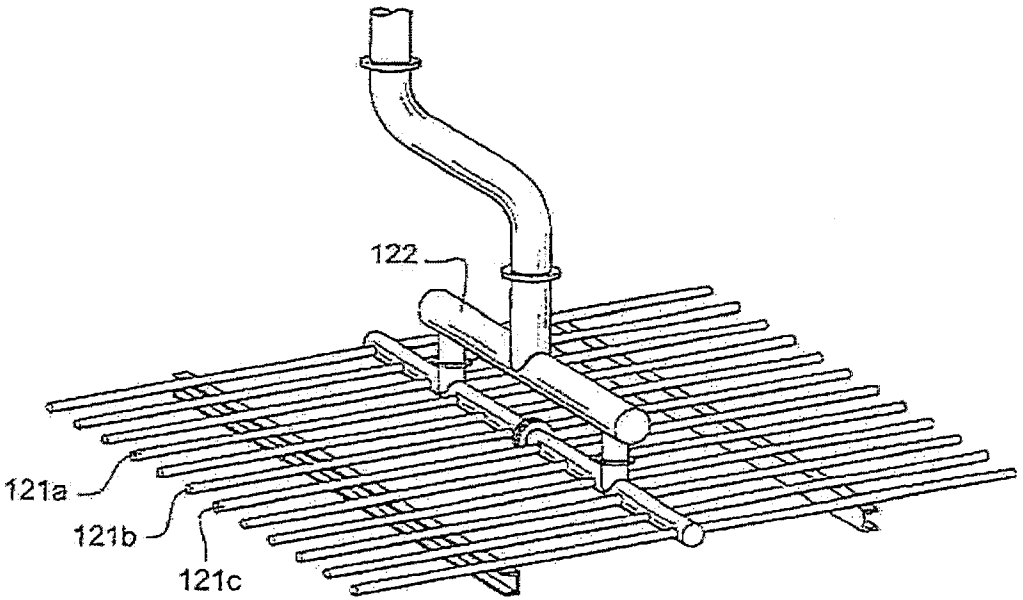
FIG. 5 is a view in cross-section of apparatus according to one embodiment of the invention.

A spray or wash water distribution system (115) comprising a plurality of pipes (121*a*, 121*b*, 121*c*) connected together in a manifold arrangement, which are fed by a pipe (122), is described with reference to FIG. 5.

Figure 6:
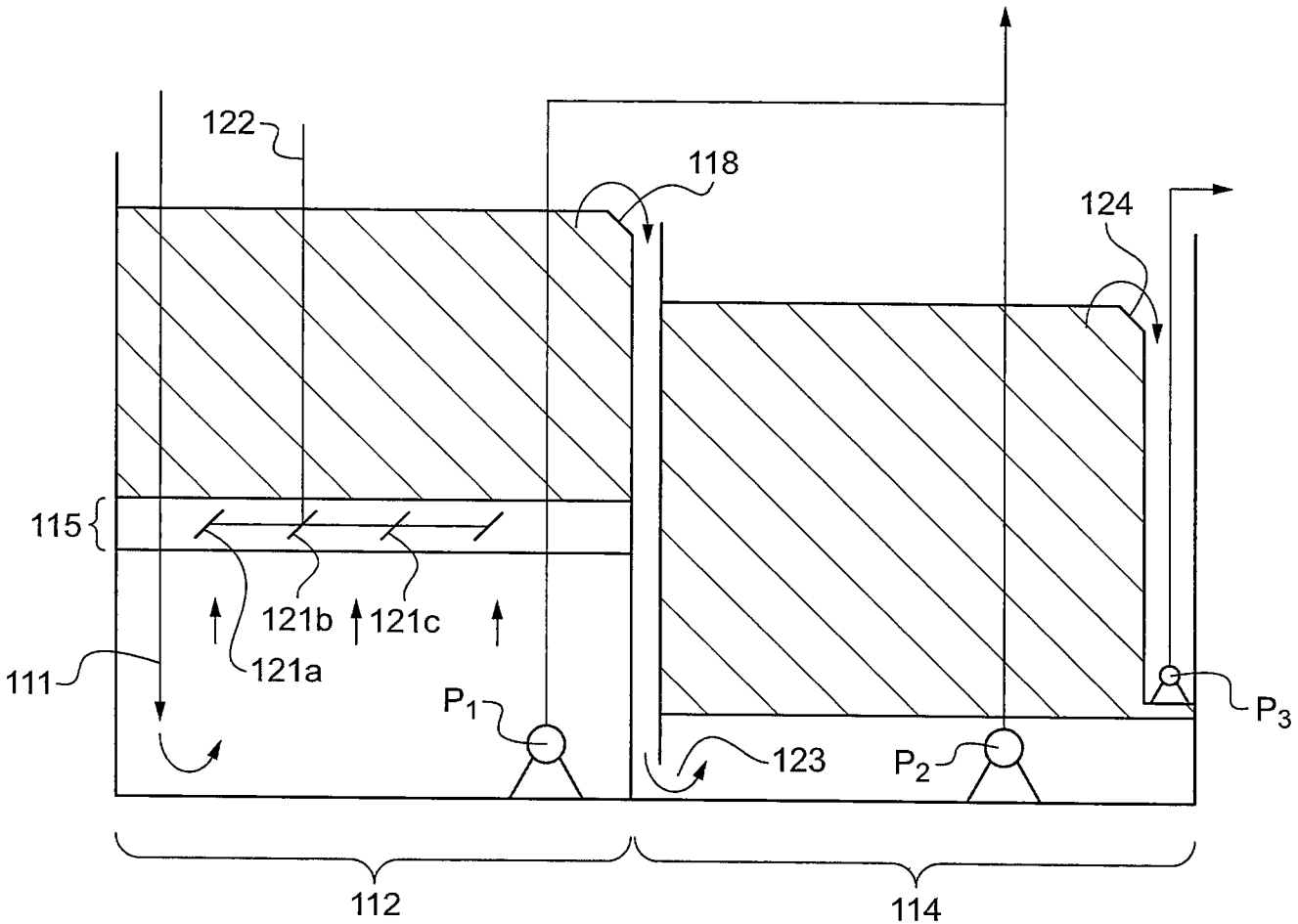
FIG. 6 is a view in cross-section of part of apparatus according to the invention.

An embodiment of the second part of the process according to the invention will be described with reference to FIG. 6. The degassed liquid fraction arrives via pipe (111) and enters the bottom of the vessel (112). The emulsion then rises towards the interface and then the oil moves towards the top where the oil phase is for example recovered at the overflow (118). The water in the bottom of the vessel (112) is pumped by a pump P1. A spray (115) is located at the water/oil interface, in particular that in the embodiment in FIG. 5. Pipes (121*a*, 121*b*, 121*c*) and (122) are shown diagrammatically. This spray is in particular fed with seawater. A make up of water may be provided so that the degassed emulsion that is treated has a water content of 15 to 35% (vol). In one embodiment, no spray will be present, especially in the case of a water leg (which is the height from the bottom of the vessel to the interface) is sufficient, typically from 3 to 15 m, especially from 4 to 12 m.

A make-up, for example of water, may be provided at overflow 118, up to a water content of a few percent.

The oil phase then flows from the overflow down to the bottom (123) of the settler (114) by a conduit. The oil also rises to the surface, as before. The water in the bottom of the settler (114) is pumped by a pump P2. The two flows from pumps P1 and P2 are passed to a water treatment unit (not shown). The oil is finally recovered using an overflow (124) and is then pumped by a pump P3, being passed to the oil storage facility (not shown).

Water make-ups can be obtained by any device useful for mixing fluids, such a valve or a static mixer.

The invention claimed is:

1. A process for the treatment of production crude comprising:

separating the production crude into a gas and a degassed emulsion;

passing the degassed emulsion into a vessel;

washing the degassed emulsion with water at an oil/water interface through a water distribution system within the vessel and located at the oil/water interface or just above, the water distribution system comprising a main pipe and a plurality of secondary pipes, the secondary pipes in fluid communication with the main pipe in a manifold arrangement;

washing the degassed emulsion with water at a gas/oil interface; and separating the degassed emulsion into water and oil.

2. The process according to claim 1, further comprising:

stripping the degassed emulsion with gas.

3. The process according to claim 1, further comprising:

settling the oil.

4. The process according to claim 1, wherein the separating the degassed emulsion operation comprises settling the degassed emulsion.

5. The process according to claim 1, wherein the degassed emulsion has a water content ranging from 15 to 35 vol %.

6. The process according to claim 1, wherein the separating the production crude operation comprises:

separating the production crude using a relatively medium to high pressure; and degassing the production crude using a relatively low pressure.

7. The process according to claim 1, wherein the production crude is separated at a temperature ranging between 35 and 75° C.

8. The process according to claim 1, wherein the production crude is separated in less than 10 minutes.

9. The process according to claim 1, wherein the production crude is a complex crude.

10. The process according to claim 1, wherein the separating the degassed emulsion operation is performed without recovery of a flow from the oil/water interface.

11. The process according to claim 1, wherein the degassed emulsion is passed near a bottom of the vessel.

12. The process according to claim 11, further comprising passing the degassed emulsion into a water leg having a height ranging from 3 to 15 meters as measured from a bottom of the vessel to the oil/water interface.

13. The process of claim 1, wherein the separating the degassed emulsion operation comprises a residence time in the vessel ranging from 4 to 24 hours.

14. An apparatus for the treatment of production crude comprising:

a separator configured to separate the production crude into a gas and a degassed emulsion, and a vessel configured to separate the degassed emulsion into water and oil, the vessel comprising a water distribution system configured to wash the degassed emulsion with water at an oil/water interface and a second water distribution system to wash the degassed emulsion with water at a gas/oil interface, where the water distribution system is located at the oil/water interface or just above, the water distribution system comprising a main pipe and a plurality of secondary pipes, the secondary pipes in fluid communication with the main pipe in a manifold arrangement.

15. The apparatus according to claim 14, further comprising:

a distributor configured to strip gas near the bottom of the vessel.

16. The apparatus according to claim 14, further comprising:

a settler positioned downstream from the vessel, the settler being configured to settle the oil.

17. The apparatus according to claim 14, wherein the vessel comprises a settler configured to settle the degassed emulsion.

18. The apparatus according to claim 14, further comprising:

a water make-up device configured to provide water to the vessel.

19. The apparatus according to claim 14, wherein the unit comprises a high or medium pressure separator and a low pressure separator.

20. The apparatus according to claim 14, wherein the unit is positioned on a topsides portion of a floating support and the vessel is positioned in a hull of the floating support.

21. The apparatus according to claim 14, wherein there is no recovery of a flow from the oil/water interface in the vessel.

22. The apparatus according to claim 14, wherein the degassed emulsion is separated using a water leg having a height ranging from 3 to 15 meters as measured from a bottom of the vessel to the oil/water interface.

23. The apparatus according to claim 14, wherein the vessel is configured to receive the degassed emulsion near the bottom of the vessel.

24. The apparatus according to claim 14, further comprising a water leg having a height ranging from 3 to 15 meters as measured from a bottom of the vessel to the oil/water interface.

25. A process for the separation of a water-in-oil hydrocarbon emulsion comprising:

passing a degassed emulsion to a bottom of a vessel;

washing the degassed emulsion with water at an oil/water interface through a water distribution system within the vessel, the water distribution system being located at the oil/water interface or just above and comprising a main pipe and a plurality of secondary pipes, the secondary pipes in fluid communication with the main pipe in a manifold arrangement;

washing the degassed emulsion with water at a gas/oil interface; and recovering a flow of oil and a flow of water.

26. The process according to claim 25, wherein the degassed emulsion has a water content ranging from 15 to 35 vol %.

27. The process according to claim 25, further comprising:

separating the degassed emulsion without recovery of a flow from the oil/water interface.

28. The process according to claim 25, wherein the degassed emulsion is passed into a water leg having a height ranging from 3 to 15 meters as measured from a bottom of a vessel to the oil/water interface.

29. The process according to claim 25, wherein the degassed emulsion is passed into a water leg near the bottom of the vessel.

30. The process according to claim 25, wherein separating the degassed emulsion comprises a residence time in the vessel ranging from 4 to 24 hours.

31. An apparatus for the treatment of production crude comprising:

a separator configured to separate the production crude into a gas and a degassed emulsion, and a vessel configured to separate the degassed emulsion into water and oil, the vessel comprising a pipe configured to pass the degassed emulsion into a water leg at a bottom of the vessel, the water leg having a height ranging from 3 to 15 meters to separate the degassed emulsion by causing the oil to rise substantially through the height of the water leg to an oil/water interface, the water leg improving coalescence between water-in-oil or oil-in-water droplets.

* * * * *